US006602404B2

(12) United States Patent
Walsh et al.

(10) Patent No.: US 6,602,404 B2
(45) Date of Patent: Aug. 5, 2003

(54) PROCESS FOR NAPHTHA REFORMING

(75) Inventors: John Francis Walsh, Houston, TX (US); Anthony Go, South Pattaya (TH); Duane Robert McGregor, Flanders, NJ (US); John William Rebeck, Cholburi (TH); Leonel Eduardo Sanchez, Guatemala City (GT)

(73) Assignee: Exxon Mobil Chemical Patents Inc., Houston, TX (US)

( * ) Notice: Subject to any disclaimer, the term of this patent is extended or adjusted under 35 U.S.C. 154(b) by 0 days.

(21) Appl. No.: 09/918,286

(22) Filed: Jul. 30, 2001

(65) Prior Publication Data

US 2002/0056663 A1 May 16, 2002

Related U.S. Application Data

(63) Continuation of application No. 09/183,128, filed on Oct. 30, 1998, now abandoned.
(60) Provisional application No. 60/063,833, filed on Oct. 30, 1997.

(51) Int. Cl.[7] ..... C10G 35/04; C10G 59/06
(52) U.S. Cl. ..... 208/134; 208/141; 208/79; 208/80; 208/92; 585/300
(58) Field of Search ..... 208/134, 141, 208/79, 80, 92; 585/300

(56) References Cited

U.S. PATENT DOCUMENTS 2,653,175 A * 9/1953 Davis ..... 208/79
2,740,751 A * 4/1956 Haensel et al. ..... 208/66
3,005,770 A * 10/1961 Lutz ..... 208/140
3,305,476 A * 2/1967 York et al. ..... 208/134
3,635,815 A * 1/1972 Kuchar ..... 208/134
3,699,035 A * 10/1972 Hughes et al. ..... 208/92
3,718,576 A * 2/1973 Hughes et al. ..... 208/141
3,753,891 A * 8/1973 Graven et al. ..... 208/139
3,821,104 A * 6/1974 Hughes et al. ..... 208/141
3,928,174 A * 12/1975 Bonacci et al. ..... 208/111.35
4,167,472 A * 9/1979 Dick et al. ..... 208/141
4,203,826 A * 5/1980 Mayes ..... 208/64
4,222,854 A * 9/1980 Vorhis et al. ..... 208/139
4,594,145 A * 6/1986 Roarty ..... 208/133
4,897,177 A * 1/1990 Nadler ..... 208/135
5,242,576 A * 9/1993 Schmidt et al. ..... 208/64
5,401,386 A * 3/1995 Morrison et al. ..... 208/138

FOREIGN PATENT DOCUMENTS

FR 2401124 * 3/1979

OTHER PUBLICATIONS

Naphtha Quality and Its Influence on the Performance of Pt–Re/Al2O3 Reforming Catalyst for the Production of Xylenes, K. Ravindranathan Thampi et al., Indian Petrochemicals Corp. Ltd., IPCL Communication No. 70, pp. 751–761.*

* cited by examiner

*Primary Examiner*—Walter D. Griffin

(57) ABSTRACT

A process comprises separating a naphtha feed into a fraction comprising $C_7^-$ hydrocarbons and a heavy $C_{8+}$ fraction, separating the $C_{8+}$ fraction into a light fraction comprising $C_8$ and/or $C_8$–$C_9$ which then is reformed to produce gasoline and/or a desired distribution of aromatics.

32 Claims, 6 Drawing Sheets

PROCESS FOR NAPHTHA REFORMING

This application is a continuation of U.S. application Ser. No. 09/183,128 filed Oct. 30, 1998, now abandoned which claimed priority to U.S. Provisional Application No. 60/063,833 filed Oct. 30, 1997.

BACKGROUND OF THE INVENTION

1. Field of the Invention

The present invention relates to a process for reforming hydrocarbons and naphthas to produce the most desirable aromatic hydrocarbons at enhanced yields.

2. Background of the Invention

Large quantities of aromatic chemicals and octane pool materials are produced by a hydrocarbon/naphtha reforming process. Demand in the aromatic chemicals market, particularly in the para-xylene (PX) market, has grown steadily over the past twenty years. However, demand in the octane pool market for motor gasoline has remained flat at best. As a result of this imbalance in the marketplace of aromatic product demand, the industry has experienced periods of time when strong incentives exist to produce more aromatic chemicals, particularly xylenes, but not to produce more octane pool hydrocarbons, such as benzene and toluene. Reforming units, or reformers, have some flexibility to respond to market-demand swings; however, even more flexibility is needed to control the distribution and ultimate yield of reforming products.

The purpose of any reforming process is to rearrange the molecular structure of feed hydrocarbon species, particularly with the objective of upgrading naphthas which, depending upon its prefeed treatment processing, is one or another of a complex mixture of paraffinic, naphthenic, and aromatic hydrocarbon species; which as a bulk composition has a low octane numbers to high octane numbers gasoline components. A reforming process also is used to produce aromatic chemicals. The reforming products—benzene, toluene, xylenes (ortho-xylene, meta-xylene, and para-xylene), ethylbenzene, and heavy aromatics (such as mesitylene, pseudocumene, ethyltoluenes and other $C_9$–$C_{12}$ aromatics)—can be recovered and sold as higher value chemical raw materials, not as part of a gasoline pool.

The chemical reactions involved in a reforming process are very complex. The reactions are commonly grouped into four categories: cracking, dehydrocyclization, dehydrogenation, and isomerization. A particular hydrocarbon/naphtha feed molecule may undergo more than one category of reaction and/or may form more than one product.

Reforming reactions were first carried out in commercial units as a thermal process. With the discovery and development of several distinct and superior catalytic reforming processes, the original thermal process became obsolete in the 1960's. Now, all reforming processes are catalyzed by either mono-functional or bi-functional reforming catalysts. A mono-functional metallic catalyst usually has only one (precious) metal catalytic sites for catalyzing the reforming reactions. Also known are bimetallic functional catalyst in which two different precious metals exist to provide two metallic catalytic sites. A bi-functional catalyst has both metal sites and acidic sites.

The selection and/or design of a particular reforming catalyst primarily depends on the hydrocarbon/naphtha feed composition, the impurities present therein, and the desired aromatic products. A catalyst can be designed, or may be selected, to favor one or more of the four categories of chemical reactions, and thereby may influence both the yield of and selectivity of conversion of paraffinic and naphthenic hydrocarbon precursors to particular aromatic hydrocarbon structures. Intensive and continuing efforts are even now being devoted to advancing reforming technology and improving the performance of reforming catalysts.

Even with the advances in catalysis for the reforming process, a need still exists to develop new and/or improved reforming processes, and duty equipment schemes, to provide the flexibility in the product-mix demanded by the world marketplace, to better use the feedstocks, and to reduce manufacturing costs.

SUMMARY OF THE INVENTION

This invention relates to a reforming process which comprises: separating a hydrocarbon feed, such as a naphtha, under first conditions effective to produce a first fraction comprising $C_{7-}$ hydrocarbons and a second fraction comprising $C_{8+}$ hydrocarbons, and thereafter separating said second $C_{8+}$ fraction in a separator under second conditions effective to produce a light fraction comprising $C_8$ and/or $C_8$–$C_9$ hydrocarbons and a heavy fraction comprising $C_{9+}$ hydrocarbons; and reforming said light fraction in a catalytic reformer under third conditions effective to produce a reforming product within which the ultimate yield of aromatic hydrocarbon products are enhanced, and particularly as respects to the $C_8$ aromatic hydrocarbons, the yield of xylenes is enhanced.

This invention comprises a processing technique, and a processing arrangement of duty equipment items, which provides for the concentration of those paraffinic and naphthenic hydrocarbon components in the $C_{7-9}$ carbon atom number range, more preferably in the $C_{8-9}$ range, and more preferably of an $C_8$ carbon atom number, which hydrocarbon species when in such concentrated form convert under reforming conditions by contact with a reforming catalyst into $C_{7-9}$ aromatic hydrocarbon structures, preferably into $C_{8-9}$ aromatic hydrocarbon structures, and most preferably into xylene hydrocarbon structures, with the reforming conversion occurring with an enhanced selectivity of conversion of these paraffinic and/or naphthenic hydrocarbon precursors into such aromatic hydrocarbon structures. Recovery of these paraffinic and naphthenic precursor hydrocarbons species from the raw hydrocarbon feedstock into a so upgraded feedstock composition for the reforming reaction is maximized to the extent most practical for maximum yield production of that aromatic hydrocarbon product structure in most market demand—either as gasoline octane boosters (BTX) or as specialty commodity chemicals (X)—during their production cycle. Thus, the processing arrangement of duty equipment items herein described provides for a great flexibility in the reforming process operation in terms of singularly using as a reforming feedstock for reforming reactions fractional hydrocarbon streams produced from a raw hydrocarbon feedstock composition, or using various mixtures of such singularly produced fractional hydrocarbon streams as a feedstock for a single or a multiple reforming reaction.

Within the context of this invention, Applicants have discovered/observed as an affect thereof that (1) to exclude by a pretreatment of a C2–16 hydrocarbon feedstock, to the maximum practical extent possible C7– hydrocarbon species, with a conservation within a C8+ concentrate stream prepared by such an upgrading treatment of a raw C2–16 hydrocarbon feedstock composition, of the C8 and higher carbon number hydrocarbon species constituents, aids in promoting the activity lifetime of a reforming catalyst for producing from the low octane value hydrocarbon structures therein (generally, normal, iso and napthenic hydrocarbon species) aromatic hydrocarbon structures of high octane values; (2) to then exclude from this C8+ concentrate stream essentially all C10+ hydrocarbons and essentially all C9 aromatic hydrocarbons, to the maximum practical extent possible with a conservation within a C8+ concentrate stream prepared by an upgrading treatment of the C8+ concentrate stream of C8 carbon number hydrocarbon constituents, significantly enhances the selectivity of their conversion to aromatic C8 hydrocarbon structures in comparison to aromatic hydrocarbon structures of a degraded carbon number—such as benzene (a C6 aromatic) and/or toluene (a C7 aromatic)—while additionally enhancing production of xylenes (C8 aromatics) compared to ethylbenzene (also a C8 aromatic).

The enhancement in yield and selectivity of conversion of that quantity of $C_{7-8}$ paraffinic and/or naphthenic hydrocarbon precursor into aromatic $C_{7-9}$ hydrocarbons, the recovery of which precursor paraffinic and/or naphthenic hydrocarbon species into the upgrade feedstock stream for reforming is maximized to the extent practical, overall as an affect, provides for a greater total absolute yield from that quantity of precursor paraffinic/napthenic hydrocarbon initially available in the raw hydrocarbon/naphtha feedstock as recoverable aromatic hydrocarbon structures—either as a mixture of BTX suitable as an octane boosting composition for an unleaded motor gasoline stock, or as single aromatic species/classes of a purity suitable for use as special commodity chemicals in the chemical production market.

Figure 1:
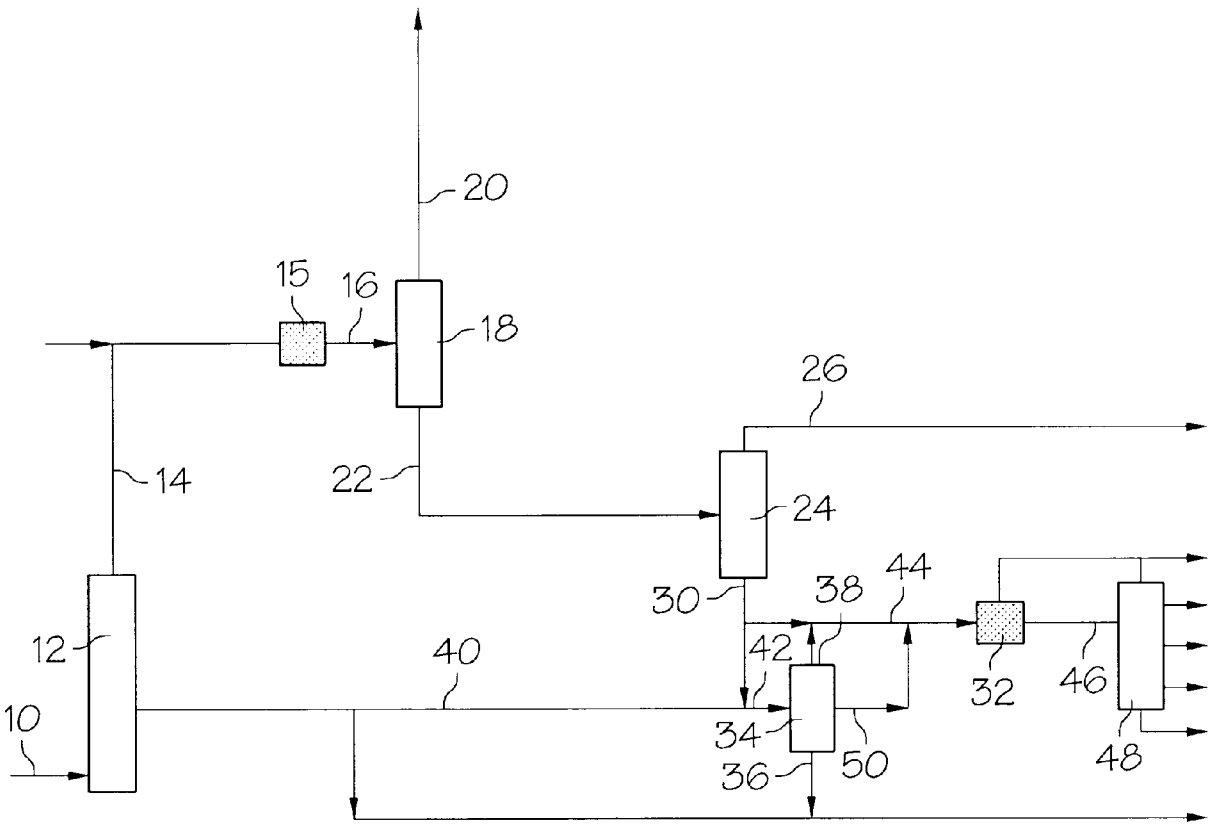
FIG. 1 is a schematic representation of a reforming process using one reformer.

As used herein, a number after a capital "C" represents a hydrocarbon species having the number of carbon atoms in their formula which appears after the "C." For instance, $C_8$ represents hydrocarbons with eight carbon atoms in their formula. $C_5$–$C_{11}$ represents hydrocarbons comprising in the range of from five carbon atoms to eleven carbon atoms. A minus sign "–" after the number, e.g. $C_{4-}$, refers to a hydrocarbon fraction consisting of primarily hydrocarbons having four or fewer carbon atoms. Similarly, a $C_{10+}$ represents a fraction comprising primarily hydrocarbons with 10 or more carbon atoms. Such $C_{4-}$ or $C_{10+}$ fractions may comprise minor amounts of hydrocarbons with a different greater or lesser, respectively, number of carbon atoms.

DETAILED DESCRIPTION OF INVENTION

The present invention relates to a reforming process which provides a better control of the composition of the feed to the reformer(s) to achieve flexibility in order to produce the desired aromatic hydrocarbon product-mix. In particular, the $C_8$ concentration in the reformer reactor feed is broadly tailorable to optimize the yields of xylenes. The $C_6$ and $C_7$ fractions in the reformer reactor feed are adjusted as desired to optimize the yields of toluene, and benzene therein. The $C_9$–$C_{11}$ concentration in the feed to the reformer (s) also may be adjusted, selectively as desired, to produce more heavy aromatic hydrocarbons, such as trimethylbenzenes, diethylbenzenes, naphthalene, and others. When two reformers are used, the present invention allows optimization of aromatic chemicals production from one reformer and gasoline octane components from the other reformer.

As used herein, the terms pipestill, separator, stabilizer, splitter, and tailing tower refer to various types of fractionators, distillation columns, distillation units, membrane separation units, and other equipment items, each of which is capable of effecting separations of hydrocarbon fractions, and combinations thereof. Commercially, these items of equipment and/or units are available from many vendors. These items/units usually are built to the specifications set by the purchaser based on the hydrocarbons to be separated, the desired separation, sharpness of the separation, etc.

The activity of a reforming catalyst for upgrading low octane value aliphatic and/or naphthenic hydrocarbon structures in the $C_6$–$C_{12}$ carbon number range declines significantly as a function of the time of exposure of such catalyst to a full range hydrocarbon mixture, such as a $C_5$-400° F. (204° C.) naphtha. Applicants have observed that the activity of such reforming catalyst is much less severely affected as a function of time when its exposure is limited to a $C_8$ and/or $C_8$–$C_9$ hydrocarbon concentrate feedstock. Whereas, the initial activity of the reforming catalyst is essentially the same for either feedstock composition, the catalyst activity for the $C_8$ and $C_8$–$C_9$ concentrate feedstock (HVN Concentrate) remains essentially constant over a long run time while the catalyst activity for the $C_5$-400° F. full range naphtha feedstock declines significantly over a similar run time period.

Thus, reducing the quantities of the $C_{7-}$ hydrocarbons and also $C_{9+}$ hydrocarbons in the feed composition to the reforming catalyst, at least in part, contributes to a longer activity lifetime for the reforming catalyst to act for conversion of the $C_8$ and/or $C_8$–$C_9$ paraffinic and naphthenic (P+N) hydrocarbons into desirable aromatic (A) hydrocarbon structures.-

Figure 3:
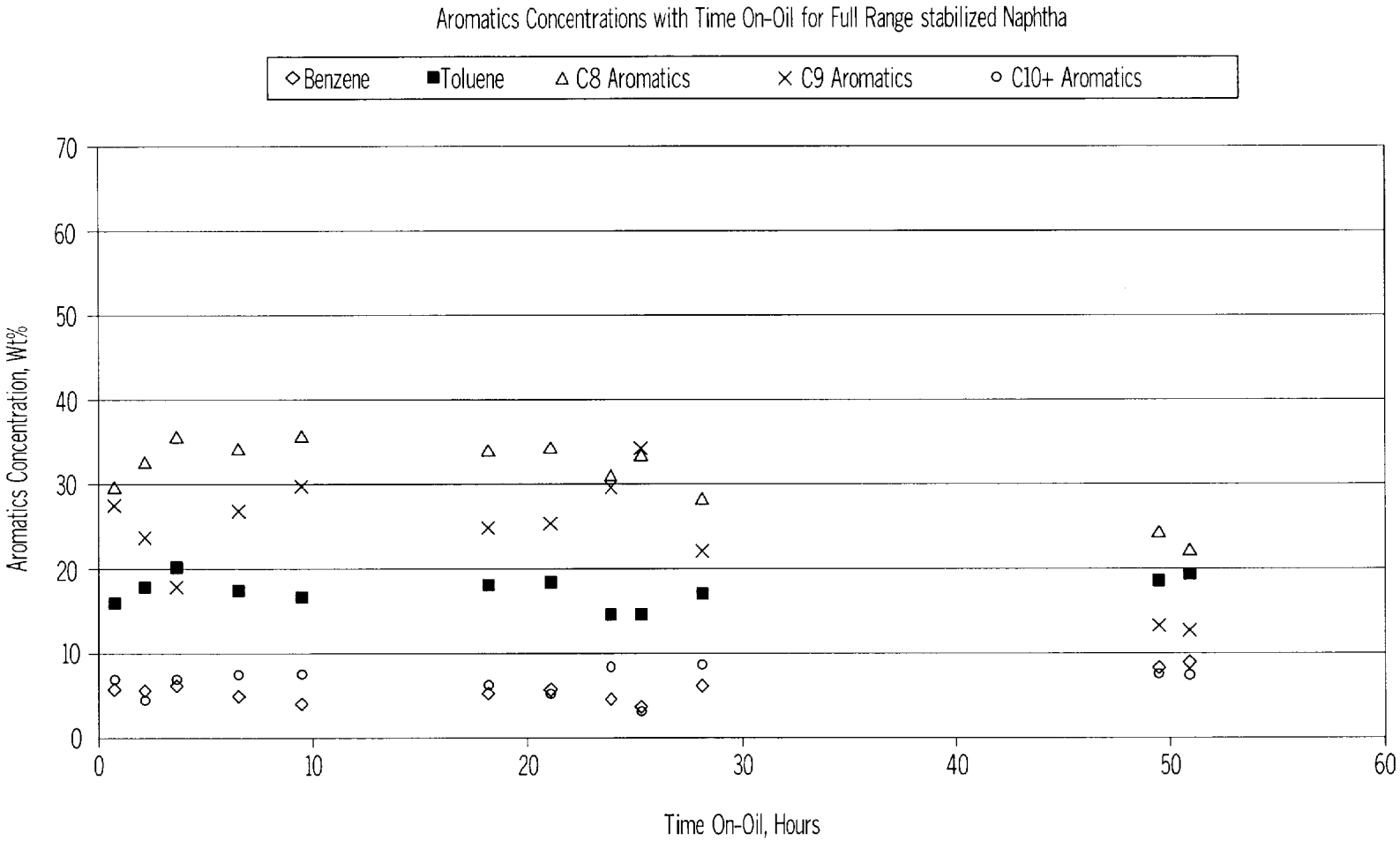
FIG. 3 is a graph which plots the production over time of the indicated $C_6$–$C_{10}$ aromatics as a wt % of the total weight of a full range stabilized naphtha feed (as identified in Table 1) when contacted with a CRITERION PS-40 Pt/Sn reforming catalyst at a WHSV of 1.3, a pressure of 50 psig (340 kPa) and a $H_2$/feed molar ratio of 1.3 and at an inlet temperature of 910° F. (488° C.) until the 25 hours on-oil point, and thereafter at an inlet temperature of 920° F. (493° C.) until the 28 hour point and thereafter at 930° F. (499° C.) inlet until the 50 hour point.

Further, Applicants have observed that if a $C_{8+}$ concentrated feedstock is further treated to reduce its quantities of $C_{9+}$ hydrocarbons, so as to form a $C_8$ concentrate feedstock, that such $C_8$ concentrate feedstock (HVN Concentrate)—by comparison to a full range $C_5$-400° F. (204° C.) naphtha—upon reforming yields, by comparison to the benzene or toluene reformate products, a greater level of $C_8$ aromatic reformate product (xylenes+ethylbenzene). This affect is reflected in FIGS. 3 and 4. The reforming runs reflected by FIGS. 3 and 4 were performed under identical conditions with the identical reforming catalyst except for feedstock composition. In FIG. 3 the feedstock was a full range naphtha whereas in FIG. 4 the feedstock was a $C_8$ concentrate prepared by a treatment of the full range naphtha to top out from it $C_{7-}$ hydrocarbon and thereafter to tail out from it by distillation to remove substantially all of its $C_{10+}$ components and a substantial portion of its $C_{9+}$ components.

For FIG. 3, based upon the weight of the full range naphtha feed the total wt % of aromatic $C_{6-10}$ product at 25 hr time on oil is about 88.3 wt % with a wt % ratio of aromatic $C_8$/aromatic $C_6$ ($AC_8/AC_6$)≅33.4/3.5 and that of $AC_8/AC_7$≅33.4/14.3. In the case of a $C_8$ concentrate feedstock, as in FIG. 4 at a 32 hr time on oil the total wt % yield of aromatic $C_{6-10}$ product based upon weight of feedstock is 90.11 wt % with a wt % ratio of $AC_8/AC_6$≅57.4/0.9 and that of $AC_8/AC_7$≅57.4/3.4. This then clearly illustrates that less of the feedstock paraffinic+naphthenic C# component precursors for production of $AC_8$ product is being diverted into production of $AC_6$ and/or $AC_7$ product compositions; meaning with a $C_8$ and/or $C_8$–$C_9$ concentrate feedstock (HVN Concentrate) the selectivity of the reforming catalyst for production of $AC_8$ compounds is significantly enhanced. This greater concentration of $AC_8$ compounds in the reformate streams makes a recovery of xylenes therefrom in high purity a much easier distillation project.

Figure 5:
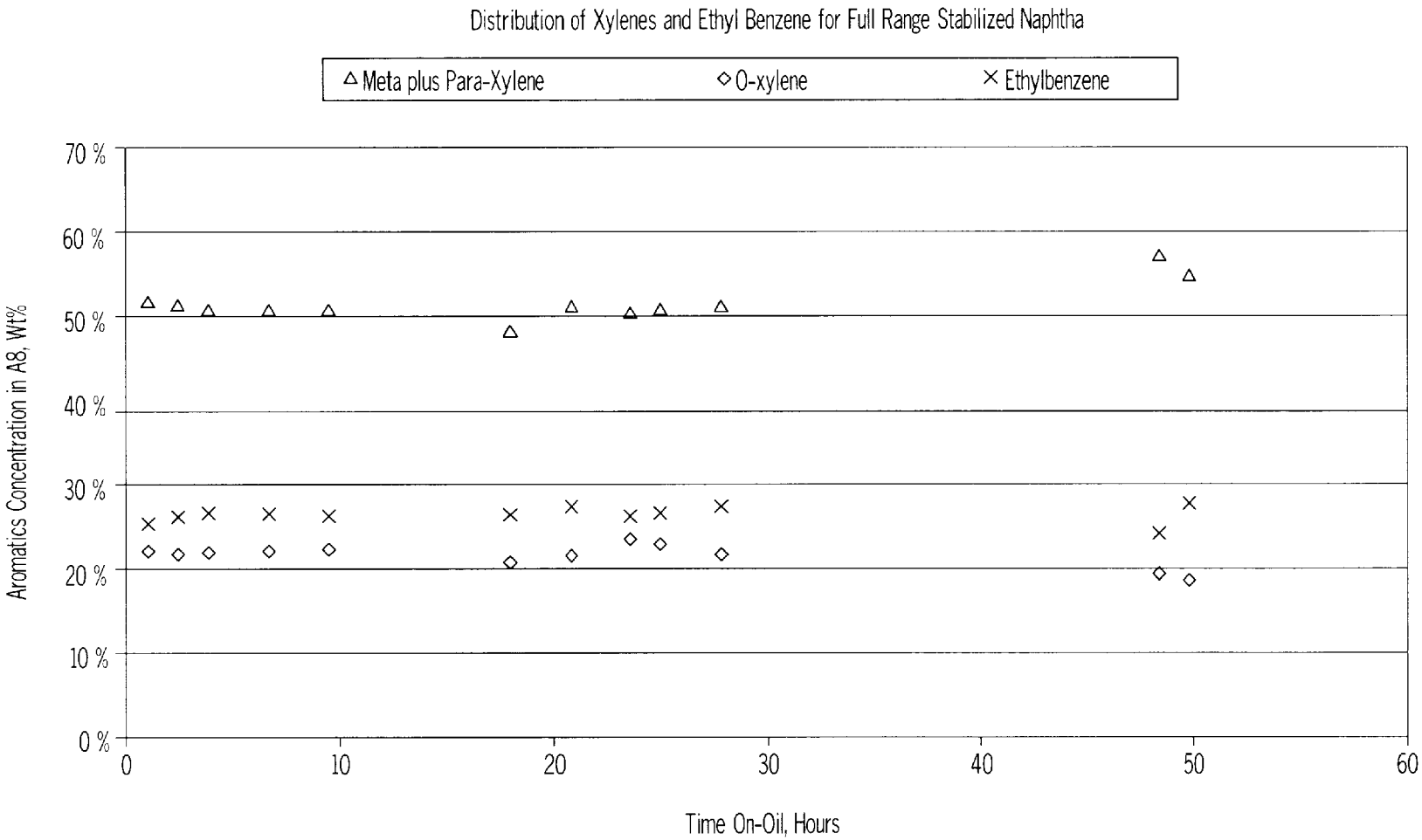
FIG. 5 is a profile graph of $C_8$ aromatic hydrocarbon species produced with a full range naphtha feedstock as in FIG. 3.
Figure 6:
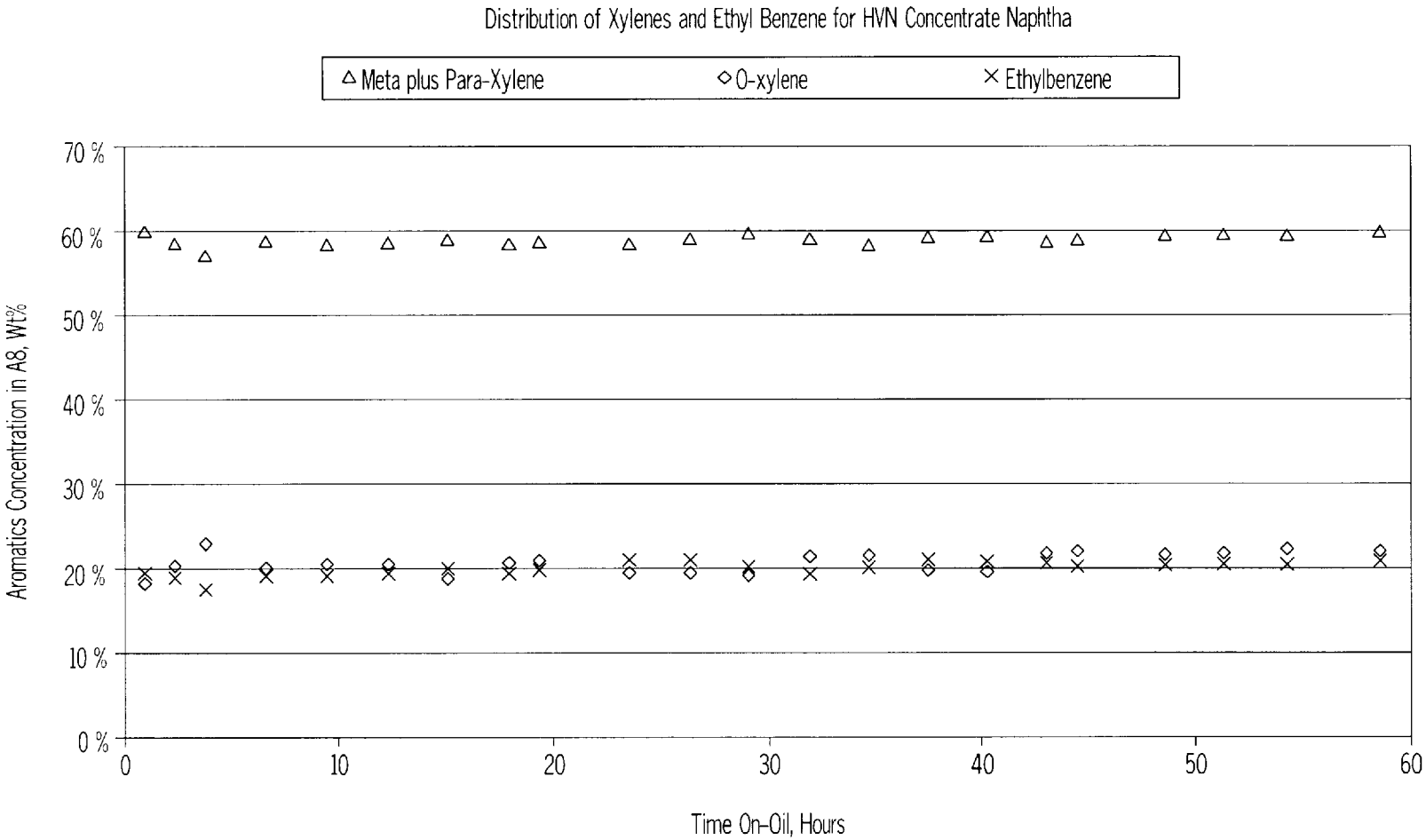
FIG. 6 is a profile graph of $C_8$ aromatic hydrocarbon species produced with a HVN concentrate feedstock as in FIG. 4.

Furthermore, Applicants have observed that in addition to a greater selectivity for production of a $AC_8$ product, that a $C_8$ concentrate feedstock produces with a reforming catalyst a process that is more selective to the production of xylenes (o, m, p) as the $C_8$ aromatics with a reduction in the quantity of the less desirable ethylbenzene. This is illustrated by FIGS. 5 and 6. With a $C_8$ concentrate feedstock as in FIG. 6 the xylenes/ethylbenzene ratio is 80/20, whereas in FIG. 5 with a full range naphtha feedstock the xylenes/ethylbenzene ratio is 73/27.

Referring to FIG. 1, as is typical/conventional in the art a crude petroleum 10 is first fed into a pipestill 12 to produce a rough cut of a $C_3$–$C_{11}$ to naphtha fraction 14, normally separated as an overhead with the $C_{11+}$ to asphathenes taken off as a bottom stream. The rough cut $C_3$–$C_{11}$ naphtha fraction 14 is, as is typical, hydrotreated in a hydrofiner 15 to remove components that would adversely affect the stability—activity, selectivity, and life of the reforming catalyst, which usually comprises noble metal components. The reforming catalyst adverse compounds altered to catalyst non-adverse components in the hydrofiner 15 are either organic or inorganic, and they typically comprise at least one of the following elements: sulfur, nitrogen, oxygen, arsenic, phosphorus, and mercury. The hydrotreating may be achieved by any of the many methods known to one skilled in the art.

After hydrotreating, the hydrotreated rough cut of the $C_3$–$C_{11}$ naphtha 16 is, as is typical, processed further through a naphtha stabilizer 18 to remove $C_{4-}$ hydrocarbons 20 as an overhead for fuels, liquid petroleum gas (LPG) processing or other disposal. The bottoms 22—a stabilized "full range" naphtha feed—is then, pursuant to one aspect of this invention, sent to a naphtha separator 24. Table 1, as follows, illustrates for discussion purposes a typical stabilized naphtha feed composition—although it should be understood that stabilized naphtha compositions may vary significantly from that illustrated in Table 1 for purposes of discussion.

TABLE 1

| Component | Weight % | 100,000 lbs/hr |
|---|---|---|
| $C_{4-}$ | 0 | |
| $C_5$ | | |
| normal- | 0.135 | 135 |
| isos | 0.039 | 39 |
| naphthenics | 0.074 | 74 |
| $C_6$ | | |
| normal | 5.054 | 5,054 |
| isos | 3.625 | 3,625 |
| naphthenic | 2.964 | 2,964 |
| aromatic | 0.644 | 644 |
| $C_7$ | | |
| normal | 6.608 | 6,608 |
| isos | 6.313 | 6,313 |
| naphthenic | 6.893 | 6,893 |
| aromatic | 3.287 | 3,287 |
| $C_8$ | | |
| normal + isos | 13.562 | 13,562 |
| naphthenic | 6.935 | 6,935 |
| aromatic | 6.099 | 6,099 |
| $C_9$ | | |
| normal + isos | 13.287 | 13,287 |
| naphthenic | 5.079 | 5,079 |
| aromatic | 6.598 | 6,598 |
| $C_{10}$ | | |
| normal + isos | 10.449 | 10,449 |
| naphthenic | 0.056 | 56 |
| aromatic | 2.301 | 2,301 |
| | 100.00 | 100,001 |

Paraffinic/Naphthenic/Aromatic = 59/22/19

The naphtha separator 24 is capable of separating $C_5$, $C_6$, and $C_7$ to form a light virgin naphtha (LVN) overhead fraction 26. The naphtha separator 24 preferably can be designed and/or controlled to make a sharp $C_7/C_8$ separation and to minimize $C_8$ losses. Preferably, of the weight of all $C_8$ hydrocarbon species existing in the stabilized naphtha feed composition 22 feed to the naphtha separator 24, no more than 15 wt % thereof, and preferably 10 wt % or less of the $C_8$ components are lost to the overhead fraction 26 taken from the naphtha separator 24. Suitable separators for the naphtha separator 24 include, but are not necessarily limited to, a distillation tower, a membrane system, or a combination of the two. A distillation tower is most preferred. When a distillation tower is used, a sharp separation can be accomplished by having more stages, or by using a larger size tower (theoretical plates). Another way of achieving sharp separation in a distillation tower is to operate at higher reflux ratios and/or lesser overhead fraction volume take-offs.

The LVN overhead fraction 26 from the naphtha separator 24 comprises primarily $C_5$, $C_6$ and $C_7$ hydrocarbons. The amount of $C_6$ and $C_7$ hydrocarbons in the LVN overhead fraction 26 is in the range of from about 0 wt % to about 95 wt %, preferably from about 20 wt % to about 80 wt %, and more preferably from about 30 wt % to about 65 wt %. The naphtha separator 24 also produces a bottoms stream 30 comprising an amount of $C_7$ in the range of from about 0 wt % to about 30 wt %.

As the amount of $C_6$ and $C_7$ hydrocarbons in the LVN overhead fraction 26 increases, the corresponding amount of $C_6$ and $C_7$ hydrocarbons in the bottoms 30 decreases. The amount of $C_7$ compounds ultimately sent to the reformer 32 can be adjusted selectively to obtain a desired product mix from the reformer 32. In order to increase the amount of $C_7$ in the LVN overhead fraction 26, the reflux ratio in the naphtha separator 24 is set to maximum and the LVN rate is adjusted to achieve the desired $C_7$ split. The $C_6$ compounds usually are reformed to benzene and fuels products, and $C_7$ compounds usually are reformed to toluene and fuels products.

The bottoms 30 from the naphtha separator 24 comprises an enhanced $C_6^-$ $C_{11}$ heavy virgin naphtha (HVN). The amount of $C_6$–$C_7$ hydrocarbons in the HVN bottoms 30 is in the range of from about 0.01 wt % to about 60 wt %. For purposes of discussion Table 2 below illustrates a composition of the LVN and the HVN streams as discussed above.

TABLE 2

| Component | LVN lbs/hr | HVN lbs/hr |
|---|---|---|
| | on 100,000 lb/hr basis | |
| $C_{4-}$ | 0 | 0 |
| $C_5$ | | |
| Normal- | 135 | 0 |
| Isos- | 39 | 0 |
| Naphthenics | 74 | 0 |
| $C_6$ | | |
| Normal | 5,054 | 0 |
| Isos | 3,625 | 0 |
| Naphthenic | 2,964 | 0 |
| Aromatic | 644 | 0 |
| $C_7$ | | |
| Normal | 6,608 | 0 |
| Isos | 6,313 | 0 |
| Naphthenic | 6,892 | 0 |
| Aromatic | 3,417 | 65 |
| $C_8$ | | |
| Normal + isos | 1,556 | 12,006 |
| Naphthenic | 1,148 | 5,787 |
| Aromatic | 0 | 6,099 |
| $C_9$ | | |
| Normal + isos | 0 | 13,287 |
| Naphthenic | 0 | 5,079 |
| Aromatic | 0 | 6,598 |
| $C_{10}$ | | |
| Normal + isos | 0 | 10,449 |
| Naphthenic | 0 | 56 |
| Aromatic | 0 | 2,301 |
| Total Hydrocarbons | 38,274 | 61,727 |

The HVN stream 30 could be sent directly to the reformer 32. However, preferably, the HVN bottoms 30 is, in accordance with the preference of this invention, sent to a naphtha tailing tower 34 to separate all of the $C_{10+}$ hydrocarbons and at least a part of the $C_9$ hydrocarbons from the HVN bottoms 30 stream as a $C_{10+}/C_9$ bottoms stream 36. For discussion purposes Table 3 illustrates a composition of the HVN stream after this bottom/tailings cutting treatment.

TABLE 3

| Component | HVN (lbs/hr) #30 | HVN concentrate (bottom cut treated) (lbs/hr) (#38) | Bottoms from HVN cut treatment (lbs/hr) (#36) |
|---|---|---|---|
| $C_7$ | | | |
| (A) aromatic | 65 | 65 | 0 |
| $C_8$ | | | |
| (P) normal + isos | 12,006 | 12,006 | 0 |
| (N) naphthenic | 5,787 | 5,787 | 0 |
| (A) aromatic | 6,099 | 6,099 | 0 |
| $C_9$ | | | |
| (P) normal + isos | 13,287 | 9,582 | 3,705 |
| (N) naphthenic | 5,079 | 2,271 | 2,288 |
| (A) aromatic | 6,598 | 181 | 6,417 |
| $C_{10}$ | | | |
| (P) normal + isos | 10,449 | 287 | 10,162 |
| (N) naphthenic | 56 | 0 | 56 |
| (A) aromatic | 2,301 | 0 | 2,301 |
| Total Hydrocarbons | 61,727 | 36,278 | 25,449 |

The $C_9/C_{10+}$ bottoms stream 36 may be used for kerosene blending and/or for jet fuel. The amount of the $C_9$ hydrocarbons, as part of the overhead 38, sent to the reformer 32 can be adjusted selectively to produce a desired product mix from the reformer 32, and the $C_9$ amount is usually in the range of from about 0 wt % to about 100 wt % of the available $C_9$ content as being a constituent of the entire stream 38 sent to the reformer 32. The products from the reformer 32 comprise primarily benzene, toluene, xylenes, ethylbenzene, and other aromatics. Alternately, the products may comprise gasoline and other fuels. Different reforming conditions may be used to achieve this flexibility in producing different reforming products.

In another embodiment of the present invention, at least a portion of a $C_8$–$C_{16}$ kerosene fraction 40, from the pipestill 12, is mixed with the $C_6$–$C_{11}$ bottoms 30 (HVN-Uncut) from the naphtha separator 24, and the mixture 42 is sent to the naphtha tailing tower 34. The $C_8$–$C_{16}$ kerosene fraction 40 comprises from about 1 wt % to about 10 wt % of $C_8$ compounds, preferably from about 5 wt % to about 8 wt % of $C_8$ compounds (P, N, A). The portion of the $C_8$–$C_{16}$ kerosene fraction 40 sent to the naphtha tailing tower 34 varies in the range of from about 0 wt % to about 100 wt % of this kerosene fraction stream 40.

The overhead fraction 38 of the naphtha tailing tower 34 comprises a concentrated or enriched $C_8$ fraction 38 in the range of from about 20 wt % to about 98 wt %, preferably from about 30 wt % to about 75 wt %, and more preferably from about 45 wt % to about 70 wt %. The concentrated $C_8$ fraction 44 then is sent to the reformer 32 to produce a product 46 comprising xylenes and other fuel products. The product 46 is further separated in the aromatic recovery until 48 to produce pure aromatic products such as benzene, toluene, ortho-xylene, meta-xylene, and para-xylene.

In another embodiment of the present invention, the naphtha tailing tower 34 is bypassed partially, or completely, and some or all of the $C_6$–$C_{11}$ bottoms (HVN) 30 is sent to the reformer 32. The amount of bypass is determined by the quantity of $C_9$–$C_{11}$ which under the processing circumstances is the most desirable to commercial reform.

In yet another embodiment, a side stream 50 comprising $C_{10}$–$C_{11}$ hydrocarbons is separated from the naphtha tailing tower 34, and sent to the reformer 32 along with the concentrated $C_8$ from the overhead fraction 38 of the naphtha tailing tower 34 to produced an increased yield of heavy aromatics. Compared with reforming the entire $C_9$–$C_{16}$ fraction from the naphtha tailing tower 34, the efficiency of heavy aromatic production is increased while deactivation of the reforming catalyst in the reformer 32 is reduced. In this embodiment, the side stream 50 comprises of in the range of 0 wt % to about 50 wt % of the mixture 44.

The reforming catalyst and conditions of reforming may be any of those known to persons having ordinary skill in the art. The catalyst may be mono-functional or bi-functional (metallic and acidic catalytic sites). Catalysts that are suitable for use in the present invention include, but are not necessarily limited to, catalysts comprising one or more metals, preferably a precious metal selected from the group consisting of Pt, Ir, Re, Ru, Sn and Pd, —so as to be a mono- or bi-and/or poly metallic-functional catalysts—and a variety of supports, preferably a support selected from the group consisting of alumina, silica, silica-alumina zeolites, chlorided alumina, fluorided alumina, and bromided alumina. Also, the catalyst may be metallic-acidic bifunctional one wherein one type of catalytic site is metallic and another is an acidic non-metallic site. The catalysts described in the U.S. Pat. Nos. 3,134,732, 3,781,219, 4,594,145, and 4,897,177 are examples of suitable catalysts. The patents are incorporated herein by reference.

The reforming reaction effective for purposes of this invention generally takes place at the following conditions: reactor inlet temperature in the range of from about 450° C. to about 565° C.; pressure in the range of from about 250 kPa to about 4000 kPa; flow rate in the range of from about 0.8 $h^{-1}$ to about 3 $h^{-1}$. The reforming conditions and regeneration conditions described in the U.S. Pat. Nos. 3,134,732, 3,781,219, 4,594,145, and 4,897,177 are incorporated herein by reference.

Figure 4:
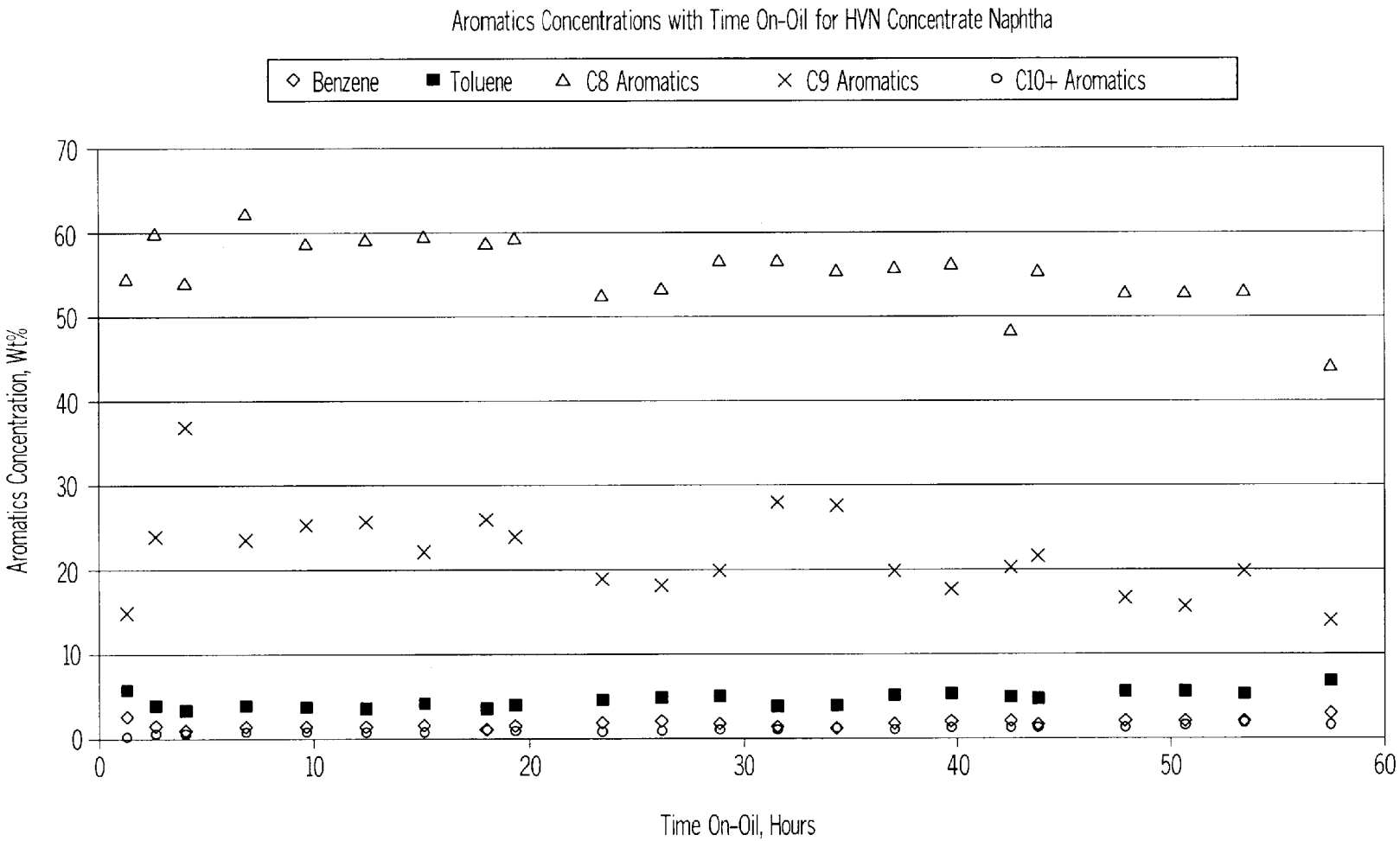
FIG. 4 is a graph which plots the production over time of the indicated $C_6$–$C_{10}$ aromatics as a wt % of the total weight of a heavy virgin naphtha (HVN) concentrate feed (as identified in Table 3) when contacted with a CRITERION PS-40 Pt/Sn reforming catalyst at a WHSV of 1.3, a pressure of 50 psig (340 kPa) and a $H_2$/feed molar ratio of 1.3 wherein the inlet temperature through 23.5 hours time on-oil was 910° F. (488° C.), after 23.5 hours through 37.5 hours inlet temperature was 920° F. (493° C.), and after 37.5 hours inlet temperature was 930° F. (499° C.).

Returning now, for a moment to the aforementioned FIGS. 3–4 and 5–6, considered in conjunction particularly with Tables 1 and 3 hereof, one can then best appreciate the superior results which this invention yields with respect to maximized production of $C_8$ and/or $C_9$ aromatic products and, in particular, the surprising enhanced production of the xylenes as products recoverable in high purity. Each of FIGS. 3 and 4 illustrate the production over various run times; of benzene, toluene, $C_8$ aromatics, $C_9$ aromatics and $C_{10}$ aromatics each as a weight percent value based upon total weight of feedstock. In FIG. 3 the feedstock was a full range naphtha as reported in Table 1, whereas in FIG. 2 the feedstock was that same full range naphtha after having first been topped of its $C_{7-}$ hydrocarbons then tailed of its $C_{10+}$ hydrocarbons and a substantial portion of its $C_9$ hydrocarbon content (hereafter "HVN Concentrate"), as reported in Table 3. At the 25 hour time on-oil point for the full range naphtha feed and at the 32 hour time on-oil for the HVN Concentrate feed, the following Table 4 gives the illustrated aromatic product distribution:

TABLE 4

| Aromatic Component (Wt %) | Full Range Naphtha 100,000 lbs/hr | HVN Concentrate 36,278 lbs/hr |
|---|---|---|
| Benzene | 3.53 | 0.9 |
| Toluene | 14.34 | 3.4 |
| $C_8$ Aromatic | 33.40 | 57.4 |
| $C_9$ Aromatic | 33.74 | 27.8 |

TABLE 4-continued

| Aromatic Component (Wt %) | Full Range Naphtha 100,000 lbs/hr | HVN Concentrate 36,278 lbs/hr |
|---|---|---|
| $C_{10}$ Aromatic | 3.32 | 0.6 |
| Total Aromatics (wt %) | 88.3 wt % | 90.1 wt % |
| $C_8$ Aromatic/Benzene | 9.46 | 63.78 |
| $C_8$ Aromatic/Toluene | 2.33 | 16.88 |

Next, turning to FIGS. 4 and 5, again in conjunction with Table 3, the results as summarized in Table 5 below are apparent:

TABLE 5

| | Full Range Naphtha 25 hour | | HVN Concentrate 32 hour | |
|---|---|---|---|---|
| Component | Feed | Product | Feed | Product |
| $C_6$; P + N | 11,643 | — | 0 | — |
| $C_6$; A initial | 644 | 644 | 0 | 0 |
| $C_6$; A Added Make | — | 2,886 | — | 326.5 |
| Total $C_6$A | 644 | 3,530 | | 326.5 |
| $C_7$; P + N | 19,813 | — | 0 | — |
| $C_7$; A initial | 3,287 | 3,287 | 65 | 65 |
| $C_7$; A Added Make | — | 11,053 | — | 1168.5 |
| Total $C_7$A | 3,287 | 14,340 | 65 | 1233.5 |
| $C_8$; P + N | 17,793 | — | 17,793 | — |
| $C_8$; A initial | 6,099 | 6,099 | 6,099 | 6,099 |
| $C_8$; A Added Make | — | 27,271 | — | 14,724.5 |
| Total $C_8$A | 6,099 | 33,370 | 6,099 | 20,823.5 |
| $C_9$; P + N | 18,366 | — | 11,853 | — |
| $C_9$; A initial | 6,598 | 6,598 | 181 | 181 |
| $C_9$; A Added Make | — | 27,142 | — | 9,904 |
| Total $C_9$A | 6,598 | 33,740 | 181 | 10,085 |
| $C_{10}$; P + N | 10,505 | — | 0 | — |
| $C_{10}$; A initial | 2,301 | 2,301 | 0 | 0 |
| $C_{10}$; A Added Make | — | 1,019 | — | 218 |
| Total $C_{10}$A | 2,301 | 3,320 | 0 | 218 |

Table 6 below illustrates the xylenes/ethyl benzene product profile of the $C_8$ aromatic product obtained from a full range naphtha compared to a HVN Concentrate feedstock.

TABLE 6

| Component | Full Range Naphtha 25 hour | HVN Concentrate 25 hour |
|---|---|---|
| o-xylene | 7,700 | 4,535 |
| m + p-xylene | 16,770 | 12,189 |
| ethyl benene | 8,900 | 4,099 |

The process arrangement herein described provides for a great flexibility in terms of either maximizing BTX production as octane boosters for the gasoline market—as in the case of sending the HNV bottoms 30 of FIG. 1 directly to the reformer 32 wherein, as Table 5 shows, 51,270 lbs/hr of $C_{6-8}$ aromatics are produced—or in maximizing production of xylenes for the special chemical market—as in the case of sending the HVN bottoms to naphtha tailing tower 34 of FIG. 1 to produce a HVN $C_8$ concentrate stream 38 that is then reformed wherein, as Table 5 shows, the total $C_6$–$C_8$ aromatics made is 22,383.5 lbs/hr of which, as Table 6 shows, 16,724 lbs/hr are xylenes.

Figure 2:
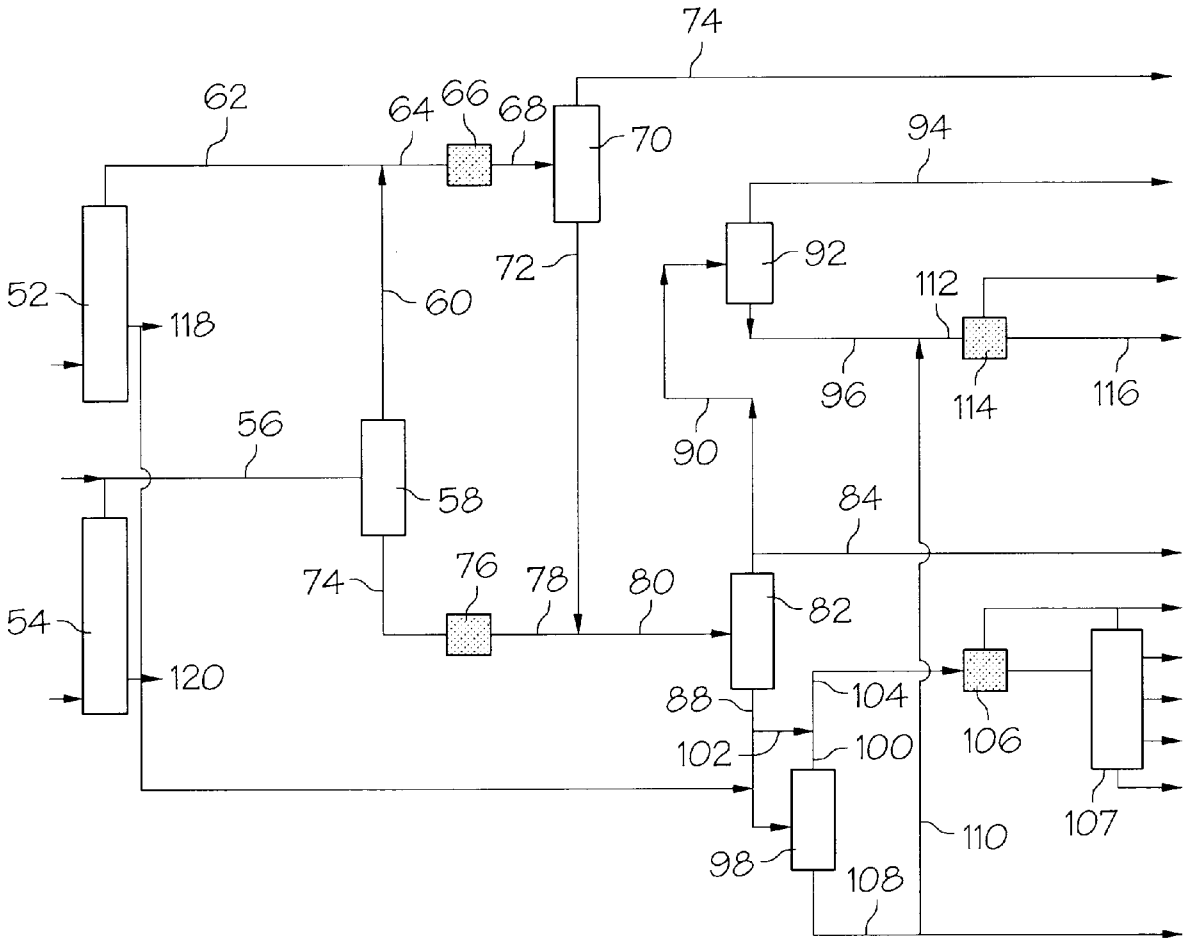
FIG. 2 is a schematic representation of the present invention using two reformers.

FIG. 2 shows another embodiment of the present invention in which a process uses two reforming units. Crude petroleum is fed into two pipestills 52 and 54. The overhead fraction 56 from the pipestill 54 is processed through a naphtha stabilizer 58. The $C_{4-}$ overhead fraction 60 from the naphtha stabilizer 58 is mixed with the overhead fraction 62 from the pipestill 52 and the mixed stream 64 is hydrotreated in a naphtha hydrofiner 66. The hydrotreated stream 68 then is processed through a naphtha stabilizer 70 to produce a $C_5$–$C_{11}$ bottoms 72 and an overhead fraction 74 comprising $C_{4-}$ compounds, which may be disposed of as light ends or sold as fuels or LPG. The bottoms 72 from the naphtha stabilizer 70 also is a "stabilized naphtha feed."

The $C_5$–$C_{11}$ bottoms stream 74 from the naphtha stabilizer 58 is hydrotreated in another naphtha hydrofiner 76. The hydrotreated stream 78 is combined with the $C_5$–$C_{11}$ bottoms stream 72 from the naphtha stabilizer 70. The combined stream 80, also called a "stabilized naphtha feed", is sent to a naphtha separator 82 which is capable of producing an overhead LVN fraction 84 comprising $C_5$, $C_6$, and $C_7$. The naphtha separator 82 preferably can be controlled to make a sharp $C_7/C_8$ separation and to minimize losses of $C_8$.

The amount of $C_6$ and $C_7$ hydrocarbons in the overhead LVN fraction 84 is in the range of from about 0 wt % to about 90 wt %, preferably from about 20 wt % to about 80 wt %, and more preferably from about 30 wt % to about 65 wt %. The amount of $C_7$ in the bottoms stream 88 is in the range of from about 0 wt % to about 30 wt %.

The overhead LVN fraction 84 can be sold, or at least a portion of it 90 can be sent to a naphtha splitter 92 to produce a light overhead $C_5$–$C_6$ fraction 94, and a heavy $C_6$–$C_7$ bottoms 96. The amount of $C_5$–$C_7$ LVN 94 to be fractionated by the naphtha splitter 92 may be varied to produce a desired product mix.

At least a portion of the bottoms 88 from the naphtha separator 82 is sent to a naphtha tailing tower 98. An overhead fraction 100 from the naphtha tailing tower 98 comprises concentrated $C_8$ compounds. Any remaining portion 102 of the bottoms 88 from the naphtha tailing tower 98 is mixed with the overhead fraction 100 and the mixture 104 is sent to a first reformer 106 and subsequently to an aromatic recovery unit 107 to produce the desired products such a benzene, toluene, ortho-xylene, meta-xylene, para-xylene, ethylbenzene, heavy aromatics, and gasoline.

A $C_9$–$C_{11}$ bottoms 108 from the naphtha tailing tower 98 can be sold as a kerosene component. Alternately, a portion 110 of the bottoms 108 is mixed with the $C_6$–$C_7$ bottoms 96 from the naphtha splitter 92 to form a feed 112 which is reformed in a second reformer 114 to produce a product 116 comprising gasoline. The product 116 may comprise benzene, toluene, and mixtures thereof. The amount of the $C_9$–$C_{11}$ bottoms stream 108 used for this purpose is in the range of from about 0 wt % to about 100 wt %.

In another embodiment of the invention using the two-reformer system, a hydrocarbon fraction comprising $C_8$ compounds is produced from the combined kerosene streams 118 and 120 of the pipestills 52 and 54, the $C_8$ rich hydrocarbon stream is mixed with the overhead fraction 100 comprising concentrated $C_8$ compounds from the naphtha tailing tower 98, and the mixture is sent to the reformer 106.

The separation of $C_8$ compounds can be performed in the naphtha tailing tower 98, but the stream 110 most preferably is set to about 0 flow since there are heavy $C_{12+}$ compounds. Alternately, the $C_8$ compounds from 118 and 120 may be removed in a separate tower and then the removed $C_8$ compounds are sent to the overhead fraction 100 from the naphtha tailing tower 98.

In a two-reformer system as represented in FIG. 2, the catalysts in the first reformer 106 and the second reformer 114 may be different. Suitable reforming catalysts for the present invention include, but are not necessarily limited to mono-functional catalysts and bi-functional catalysts as described above. The catalysts described in the U.S. Pat. Nos. 3,134,732, 3,781,219, 4,594,145, and 4,897,177 are examples of suitable catalysts. The patents are incorporated herein by reference.

The reforming conditions in the reformers also may be different, depending on the feed composition, the catalyst, and the desired products. Generally, the reforming conditions are within the parameters discussed above. The key is that the reformers are operated under conditions effective to take advantage of the various feed compositions obtained according to the present invention to produce desired products. The reforming conditions and regeneration conditions described in the U.S. Pat. Nos. 3,134,732, 3,781,219, 4,594,145, and 4,897,177 are incorporated herein by reference.

The present invention is suitable for applications in a grass roots plant, an expansion plant, or an add-on unit to an existing naphtha processing/reforming plant.

The present invention will be better understood with reference to the following examples, which are intended to illustrate, but not to limit the scope or spirit of the invention. The invention is solely defined by the claims.

EXAMPLE I

A crude petroleum stream is subjected to a rough separation in a pipestill to produce a product comprising $C_3$–$C_{11}$ cut naphtha as an overhead stream. The $C_3$–$C_{11}$ naphtha stream is hydrotreated in a naphtha hydrofiner and then fed into a naphtha stabilizer to remove $C_{4-}$ hydrocarbons and produce a product comprising a stabilized naphtha. The product comprising the stabilized naphtha is sent to a separator which is capable of producing an overhead stream of light virgin naphtha (LVN) comprising essentially all $C_5$ hydrocarbons contained in the stabilized naphtha, and a substantial amount of $C_6$ and $C_7$ hydrocarbons. The LVN comprises $C_6$ and $C_7$ hydrocarbons in the range of from about 0 wt % to about 90 wt %, preferably from about 20 wt % to about 80 wt %, and more preferably from about 30 wt % to about 65 wt %.

The bottoms stream is sent to a tailing tower to remove some $C_9$ hydrocarbons and substantially all of the $C_{10+}$ hydrocarbons to form a kerosene/jet fuel stream. The tailing tower overhead comprises a concentrated $C_8$ fraction in the range of from about 20 wt % to about 80 wt % of $C_8$ compounds. The concentrated or enriched $C_8$ fraction from the tailing tower is sent to the reformer and subsequently to a heavy aromatic tower to produce a product comprising xylenes and other hydrocarbons.

EXAMPLE II

The same process as in EXAMPLE I is carried out except that from about 1 wt % to about 100 wt % of the $C_8$ to $C_{16}$ kerosene stream from the pipestill, which comprises a $C_8$ fraction in the range of from about 1 to about 10 wt %, is sent to the naphtha tailing tower to recover about 50 wt % to about 99.9 wt % of the $C_8$ hydrocarbons from the $C_8$ to $C_{16}$ stream. After reforming the total yield of xylenes is enhanced.

EXAMPLE III

The same process as described in EXAMPLE I is carried out except that from about 0 wt % to about 100 wt % of a side stream from the naphtha tailing tower, consisting essentially of $C_{10}$–$C_{11}$ hydrocarbons, is sent to the reformer along with the concentrated $C_8$ stream. The product comprises higher amounts of heavy aromatic hydrocarbons. The heavy aromatic hydrocarbons in the product are in the range of from about 0 wt % to about 50 wt %.

EXAMPLE IV

The same process as in EXAMPLE I is carried out, except that the $C_6$–$C_{11}$ bottoms stream from the separator is sent directly to the reformer to produce product, bypassing the naphtha tailing tower. The concentration of the $C_8$ compounds in the feed to the reformer is only about 20 wt %.

EXAMPLE V

Crude petroleums are subjected to rough separations in two pipestills to produce $C_{4-}$ overhead fractions. The overhead fraction from one pipestill is processed through a first naphtha stabilizer. The overhead fraction from the naphtha stabilizer is mixed with the overhead fraction from the other pipestill and the combined stream is hydrotreated in a hydrofiner. The hydrotreated stream then is processed through a second naphtha stabilizer to produce a $C_5$–$C_{11}$ bottoms stream and an overhead fraction comprising of $C_{4-}$ compounds.

The $C_5$–$C_{11}$ bottoms stream from the first naphtha stabilizer is hydrotreated in a second naphtha hydrofiner. The hydrotreated stream from the second hydrofiner is combined with the $C_5$–$C_{11}$ bottoms stream from the second naphtha stabilizer. The combined stream is sent to a naphtha separator which is capable of sharply separating an overhead LVN fraction comprising of $C_5$, $C_6$, and $C_7$. The amount of $C_6$ and $C_7$ hydrocarbons in the overhead LVN fraction is in the range of from about 0 wt % to about 90 wt %, preferably from about 20 wt % to about 80 wt %, and more preferably from about 30 wt % to about 65 wt %. This LVN is sent to a naphtha splitter to produce a light $C_5$–$C_6$ fraction for LVN, and a heavy $C_6$–$C_7$ fraction.

A portion of the bottoms stream from the naphtha separator is sent to a naphtha tailing tower. An overhead fraction comprising concentrated $C_8$ compounds is produced from naphtha tailing tower. The remaining portion from the bottoms fraction from the naphtha separator is mixed with the overhead fraction from the naphtha tailing tower and the mixture is sent to a first reformer and subsequently processed to produce a product comprising aromatic chemicals—benzene, toluene, xylenes, and heavy aromatics. The reforming conditions may be adjusted to produce a product comprising gasoline.

A portion of the $C_9$–$C_{11}$ bottoms stream from the naphtha tailing tower is mixed with the $C_6$–$C_7$ bottoms stream from the naphtha splitter to form a mixture which is reformed in another reformer and subsequently processed to produce a product comprising gasoline. The reforming conditions may be adjusted to produce a product comprising benzene, toluene, and mixtures thereof.

Persons of ordinary skill in the art will recognize that many modifications may be made to the present invention without departing from the spirit and scope of the present invention. The embodiments described herein are meant to be illustrative only and should not be taken as limiting the invention, which is defined in the following claims.

What is claimed is:

1. A reforming process comprising:

separating a hydrocarbon feed under first conditions effective to produce a first fraction comprising C7– hydrocarbons and a second fraction comprising C8+ hydrocarbons;

separating said second fraction in a separator under second conditions effective to produce a light fraction comprising C8 hydrocarbons and a heavy fraction comprising essentially all C10+ hydrocarbons and essentially all C9 aromatic hydrocarbons; and reforming said light fraction in a reformer under third conditions effective to produce a reforming product.

2. The process of claim 1 wherein said light fraction comprises $C_8$ hydrocarbons in the range of from about 20 wt % to about 98 wt %.

3. The process of claim 1 wherein said light fraction comprises $C_8$ hydrocarbons in the range of from about 30 wt % to about 75 wt %.

4. The process of claim 1 wherein said light fraction comprises $C_8$ hydrocarbons in the range of from about 45 wt % to about 70 wt %.

5. The process of claim 1 wherein said first fraction comprises $C_6$ and $C_7$ hydrocarbons in the range of from about 0 wt % to about 90 wt %.

6. The process of claim 1 wherein said first fraction comprises $C_6$ and $C_7$ hydrocarbons in the range of from about 20 wt % to about 80 wt %.

7. The process of claim 1 wherein said first fraction comprises $C_6$ and $C_7$ hydrocarbons in the range of from about 30 wt % to about 65 wt %.

8. The process of claim 1 further comprising mixing a $C_8$–$C_{16}$ kerosene stream to said separator.

9. The process of claim 1 further comprising feeding a $C_{10}$–$C_{11}$ stream to said reformer.

10. The process of claim 1 wherein said reforming product comprises benzene, toluene, xylenes, ethylbenzene, and heavy aromatics.

11. A reforming process comprising:

separating a naphtha feed under first conditions effective to produce a first fraction comprising C6 and C7 hydrocarbons in the range of from about 20 wt % to about 80 wt % and a second fraction comprising C8+ hydrocarbons;

separating said second fraction in a separator under second conditions effective to produce a light fraction comprising C8 hydrocarbons in the range of from about 20 wt % to about 98 wt % and a heavy fraction comprising essentially all C10+ hydrocarbons and essentially all C9 aromatic hydrocarbons; and reforming said light fraction in a reformer under third conditions effective to produce a reforming product comprising benzene, toluene, xylenes, ethylbenzene, and heavy aromatics.

12. The process of claim 11 further comprising feeding a $C_{10}$–$C_{11}$ stream to said reformer.

13. A reforming process comprising:

separating a hydrocarbon feed under first conditions effective to produce a first fraction comprising C7– hydrocarbons and a second fraction comprising C8+ hydrocarbons;

separating said second fraction in a first separator under second conditions effective to produce a light fraction comprising C8 hydrocarbons and a heavy fraction comprising essentially all C10+ hydrocarbons and essentially all C9 aromatic hydrocarbons;

reforming said light fraction in a first reformer under third conditions effective to produce a first reforming product;

separating said first fraction in a second separator under fourth conditions effective to produce a third fraction comprising C6 and C7 hydrocarbons; and reforming said heavy fraction and said third fraction in a second reformer under fifth conditions effective to produce a second reforming product.

14. The process of claim 13 wherein said light fraction comprises $C_8$ hydrocarbons in the range of from about 20 wt % to about 98 wt %.

15. The process of claim 13 wherein said light fraction comprises $C_8$ hydrocarbons in the range of from about 30 wt % to about 75 wt %.

16. The process of claim 13 wherein said light fraction comprises $C_8$ hydrocarbons in the range of from about 45 wt % to about 70 wt %.

17. The process of claim 13 wherein said light fraction comprises $C_6$ and $C_7$ hydrocarbons in the range of from about 0 wt % to about 90 wt %.

18. The process of claim 13 wherein said light fraction comprises $C_6$ and $C_7$ hydrocarbons in the range of from about 20 wt % to about 80 wt %.

19. The process of claim 13 wherein said light fraction comprises $C_6$ and $C_7$ hydrocarbons in the range of from about 30 wt % to about 65 wt %.

20. The process of claim 13 further comprising feeding one or more a $C_8$–$C_{16}$ kerosene streams to said first separator.

21. The process of claim 13 wherein said first reforming product comprises ortho-xylene, meta-xylene, para-xylene, and mixtures thereof.

22. The process of claim 13 wherein said second reforming product consisting essentially of benzene, toluene, and mixtures thereof.

23. The process of claim 13 wherein different reforming catalysts are used in said first reformer and said second reformer.

24. The process of claim 13 wherein the same reforming catalysts are used in said first reformer and said second reformer.

25. A process for reforming paraffinic and naphthenic hydrocarbons of a feedstock containing C5 through at least C11 hydrocarbons into aromatic hydrocarbon structures, said process having a flexibility for separating said feedstock into a desirable fraction for reforming to, as desired, enhance yield of C6–C8 aromatic hydrocarbons or yield of C7–C8 aromatic hydrocarbons or yield of xylene hydrocarbons, comprising the steps of:

(a) topping said feedstock to separate therefrom (1) as a first fraction substantially all C5 and lower weight hydrocarbons, said first fraction containing from about 0 wt % to about 95 wt % of C6–C7 hydrocarbons and of the C8 hydrocarbon content of said feed, containing 15% or less of said C8 hydrocarbons, and (2) as a second fraction one comprising C8+ hydrocarbons;

(b) when maximum production of benzene-toluene-xylenes (BTX) is desired, then (1) feeding said second fraction over a reforming catalyst under conditions effective for reforming its C6–C9 hydrocarbons to BTX; when maximum production of xylenes is desired, then (2) treating said second fraction to tail out of it as a third fraction essentially all C10+ hydrocarbons and essentially all C9 aromatic hydrocarbon and thereafter reforming said treated second fraction under conditions effective to reform its C8–C9 hydrocarbons into xylenes.

26. The process of claim 25, wherein BTX yield is maximized by limiting $C_6$–$C_7$ in said first fraction to no greater than about 20 wt % and feeding said second fraction over a reforming catalyst.

27. The process of claim 25, wherein xylene yield is maximized by preparing said first fraction to contain at least about 80 wt % C6–C7 hydrocarbons and treating said second fraction to tail out essentially all C10+ hydrocarbons and essentially all C9 aromatic hydrocarbons and thereafter reforming said treated second fraction.

28. The process of claim 27, wherein reforming of said treated second fraction is conducted over a catalyst comprising alumina containing Pt and Sn.

29. The process of claim 27, wherein said treated second fraction comprises at least about 65 wt % $C_8$ hydrocarbons and no more than about 0.5 wt % $C_9$ aromatic hydrocarbons and no more than about 0.8 wt % $C_{10}$ paraffinic hydrocarbons.

30. The process of claim 29, wherein said treated second fraction is reformed.

31. The process of claim 27, wherein said second fraction is mixed with a $C_8$–$C_{16}$ kerosene stream and thereafter treated to tail out of it essentially all $C_{10+}$ hydrocarbons and essentially all $C_9$ aromatic hydrocarbons and thereafter reforming said treated second fraction.

32. The process of claim 25, wherein TX production is maximized with a reduction in B production by limiting $C_7$ hydrocarbon content in said first fraction to about 0 wt %, and reforming said second fraction.

* * * * *